US008909095B2

(12) United States Patent
Yamane et al.

(10) Patent No.: US 8,909,095 B2
(45) Date of Patent: Dec. 9, 2014

(54) PROCESS CARTRIDGE FOR IMAGE FORMING APPARATUS INCLUDING A HOLLOW ALIGNMENT SHAFT

(75) Inventors: Masayuki Yamane, Kanagawa (JP); Kunihiro Ohyama, Tokyo (JP); Hideki Kimura, Kanagawa (JP); Masaki Takahashi, Kanagawa (JP); Yoshihiro Fujiwara, Kanagawa (JP); Toshiki Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 13/588,380

(22) Filed: Aug. 17, 2012

(65) Prior Publication Data

US 2013/0064570 A1 Mar. 14, 2013

(30) Foreign Application Priority Data

Sep. 9, 2011 (JP) ..... 2011-196778
May 17, 2012 (JP) ..... 2012-113175

(51) Int. Cl.
*G03G 21/16* (2006.01)
*G03G 21/18* (2006.01)
*G03G 15/08* (2006.01)

(52) U.S. Cl.
CPC ..... *G03G 21/1814* (2013.01); *G03G 15/0893* (2013.01); *G03G 2215/0838* (2013.01)
USPC ..... 399/111; 399/119

(58) Field of Classification Search
USPC ..... 399/111, 119, 113, 114, 107
See application file for complete search history.

(56) References Cited

U.S. PATENT DOCUMENTS

| | | | | |
|---|---|---|---|---|
| 6,381,430 | B1 * | 4/2002 | Yokomori et al. | 399/119 |
| 6,442,359 | B1 * | 8/2002 | Numagami et al. | 399/111 |
| 2002/0076235 | A1 * | 6/2002 | Matsuzaki | 399/111 |
| 2010/0202805 | A1 | 8/2010 | Miyoshi et al. | |
| 2010/0254727 | A1 * | 10/2010 | Miller | 399/111 |
| 2010/0329699 | A1 | 12/2010 | Ohyama et al. | |
| 2011/0008075 | A1 | 1/2011 | Taguchi et al. | |
| 2011/0058857 | A1 | 3/2011 | Hori et al. | |

(Continued)

FOREIGN PATENT DOCUMENTS

| | | | |
|---|---|---|---|
| JP | 2007-047720 | 2/2007 | |
| JP | 2007047720 A * | 2/2007 | G03G 21/16 |

OTHER PUBLICATIONS

U.S. Appl. No. 13/355,020, filed Jan. 20, 2012, Yoshihiro Fujiwara, et al.

*Primary Examiner* — Benjamin Schmitt
*Assistant Examiner* — Matthew Miller
(74) *Attorney, Agent, or Firm* — Oblon, Spivak, McClelland, Maier & Neustadt, L.L.P.

(57) ABSTRACT

A process cartridge installed in a body of an image forming apparatus includes an image bearer, a development device that includes a developer bearer, a rotary developer conveyance member, and a shaft projecting from a development casing in an axial direction, a gear train including an idler gear provided to the shaft projecting from the development casing, a first side plate, and a hollow shaft projecting in the axial direction from the first side plate. The first side plate includes an image bearer positioning portion and a developer bearer positioning portion to support axial end portions of the developer bearer and the image bearer, the shaft projecting from the development casing is inserted into a recess inside the hollow shaft, and the hollow shaft is inserted into a hollow shaft positioning hole formed in the body.

19 Claims, 7 Drawing Sheets

(56) References Cited

U.S. PATENT DOCUMENTS

| | | | | |
|---|---|---|---|---|
| 2011/0058858 | A1 | 3/2011 | Fukuda et al. | |
| 2011/0150525 | A1 | 6/2011 | Fujiwara et al. | |
| 2011/0176820 | A1 | 7/2011 | Kadota et al. | |
| 2011/0194874 | A1 | 8/2011 | Masuda et al. | |
| 2011/0222871 | A1 | 9/2011 | Suzuki et al. | |
| 2011/0236063 | A1* | 9/2011 | Handa et al. | 399/119 |
| 2011/0236064 | A1* | 9/2011 | Fujii | 399/119 |
| 2011/0311281 | A1 | 12/2011 | Ohyama et al. | |
| 2012/0033998 | A1 | 2/2012 | Hori et al. | |
| 2012/0051793 | A1 | 3/2012 | Kudo et al. | |
| 2012/0134702 | A1 | 5/2012 | Fujiwara | |
| 2012/0141169 | A1 | 6/2012 | Yamane et al. | |
| 2013/0051815 | A1* | 2/2013 | Itabashi et al. | 399/12 |

* cited by examiner

PROCESS CARTRIDGE FOR IMAGE FORMING APPARATUS INCLUDING A HOLLOW ALIGNMENT SHAFT

CROSS-REFERENCE TO RELATED APPLICATIONS

This patent application is based on and claims priority pursuant to 35 U.S.C. §119 to Japanese Patent Application Nos. 2011-196778, filed on Sep. 9, 2011, and 2012-113175, filed on May 17, 2012, in the Japan Patent Office, the entire disclosure of each of which is hereby incorporated by reference herein.

FIELD OF THE INVENTION

The present invention generally relates to an image forming apparatus such as a photocopier, a facsimile machine, a printer, or a multifunction machine having several of those capabilities, and a process cartridge removably installed therein.

BACKGROUND OF THE INVENTION

In image forming apparatuses, a photoreceptor drum serving as an image bearer, a development device, and the like are often housed in a common unit casing, thus forming a process cartridge (i.e., a modular unit) removably installed in the image forming apparatus.

In process cartridges, it is necessary to secure a gap between the photoreceptor drum and a development roller (i.e., a developer bearer) of the development device with a high degree of accuracy for good performance in image development. Accordingly, typically a rotary shaft of the development roller and that of the photoreceptor drum are held at both axial end positions by a side plate, serving as a planar connector, of the process cartridge to determine the distance between the development roller and the photoreceptor drum. To determine the position of the process cartridge relative to a body of the image forming apparatus, a positioning pin is provided to the planar connector, and a positioning hole in which the positioning pin fits is formed in the body of the image forming apparatus.

Additionally, a gear train is provided to the development device incorporated in the process cartridge for rotating the development roller and a developer conveyance member in predetermined directions at desired rotational frequencies, respectively. The gear train includes an idler gear rotatably attached to a shaft or rod projecting from a casing of the development device (hereinafter "development casing").

In conventional process cartridges, when a relatively heavy load is applied to the development roller or the developer conveyance member, it is possible that the shaft rotatably supporting the idler gear is broken and falls down.

To prevent breakage of the shaft of the idler gear, a shaft insertion hole may be formed in the side plate of the process cartridge for supporting a tip of the shaft so that the shaft can be supported by both of the side plate of the process cartridge and the development casing. In this approach, however, a space dedicated for the shaft insertion hole must be secured at a specific position separately for insertion holes into which the rotary shafts of the development roller the photoreceptor drum are inserted, thereby determining the distance between them, or positioning holes for positioning of the process cartridge relative to the body of the image forming apparatus.

This can impose a layout limitation, thus increasing the size of the side plate itself, the development device, and the entire process cartridge.

BRIEF SUMMARY OF THE INVENTION

In view of the foregoing, one embodiment of the present invention provides a process cartridge removably installed in a body of an image forming apparatus. The process cartridge includes an image bearer to rotate in a predetermined direction, and a development device to develop a latent image formed on the image bearer with developer, a gear train, a first side plate, and a hollow shaft projecting from the first side plate in an axial direction of the developer bearer. The development device includes a developer bearer disposed rotatably and facing the image bearer, a developer conveyance member to rotate and transport developer inside the development device, and a shaft projecting from a development casing in the axial direction. The gear train transmits a driving force to the developer bearer and the developer conveyance member and includes an idler gear rotatably provided to the shaft projecting from the development casing. The first side plate is configured to determine a distance between a rotary shaft of the image bearer and a rotary shaft of the developer bearer and includes an image bearer positioning portion and a developer bearer positioning portion to rotatably support axial end portions of the image bearer and the developer bearer, respectively. The hollow shaft projecting from the first side plate is inserted into a hollow shaft positioning hole formed in the body of the image forming apparatus, and the shaft projecting from the development casing is inserted into a recess formed inside the hollow shaft.

Another embodiment provides an image forming apparatus that includes a body and the process cartridge described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
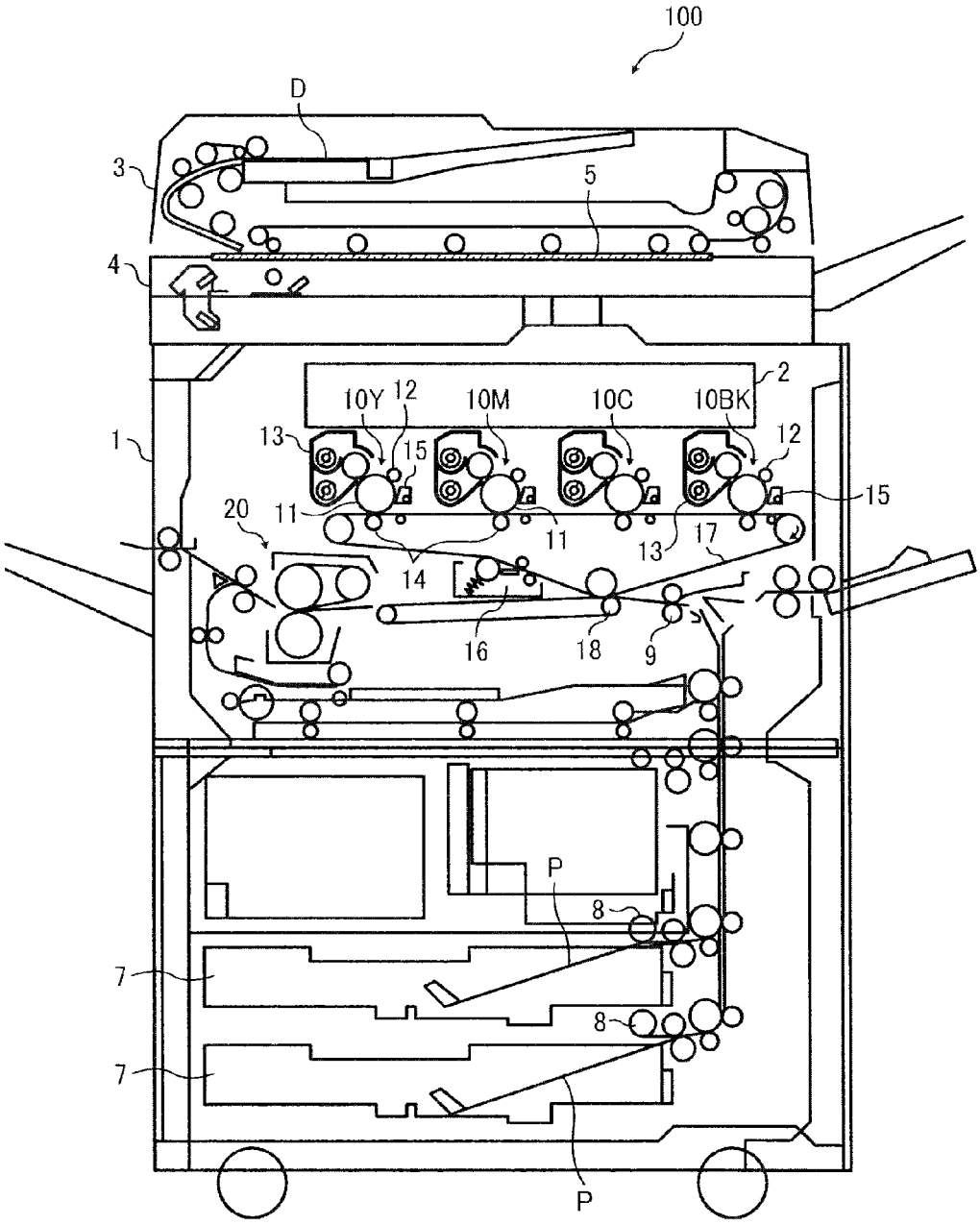
FIG. 1 is a schematic diagram illustrating a configuration of an image forming apparatus according to an embodiment of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

It is to be noted that the term "process cartridge" used in this specification means a unit including an image bearer and at least one of a charging unit, a development device, and a cleaning unit housed in a common unit casing and is designed to be removably installed in a body (hereinafter "apparatus body") of an image forming apparatus.

Additionally, the term "side plate" used in this specification means a member for determining the distance between rotary shafts of an image bearer and a developer bearer, and the shape is not limited to planar shapes.

FIG. 1 illustrates a configuration of an image forming apparatus 100 according to an embodiment.

In FIG. 1, reference numbers 1 represents a body of the image forming apparatus 100 (hereinafter "apparatus body 1"), 2 represents a writing unit to emit laser beams according to image data, 3 represents a document feeder to send an original document D to a document reading unit 4 that reads image data of the original document D, 7 represents a sheet cassette containing sheets P of recording media, 8 represents feed rollers, 9 represents a pair of registration rollers to adjust the timing to transport the sheet P, 11 represents photoreceptor drums serving as image bearers on which yellow, magenta, cyan, and black toner images are formed, respectively, 12 represents charging members to charge surfaces of the respective photoreceptor drums 11, 13 represents development devices to develop electrostatic latent images formed on the respective photoreceptor drums 11, 14 represents transfer bias rollers or primary-transfer rollers to transfer toner images formed on the respective photoreceptor drums 11 onto an intermediate transfer belt 17, and 15 represents cleaning units to clean the surfaces of the respective photoreceptor drums 11.

In the present embodiment, the photoreceptor drum 11, the charging member 12, and the cleaning unit 15 are housed in a common unit casing, thus forming a process cartridge 10 that is removably installed in an apparatus body 1. That is, the process cartridge 10 is replaceable.

Additionally, reference number 16 represents a belt cleaning unit to clean a surface of the intermediate transfer belt 17, 18 represents a secondary-transfer bias roller to transfer the toner image from the intermediate transfer belt 17 onto the sheet P, and 20 represents a fixing device to fix the toner image on the sheet P.

Additionally, although not shown in FIG. 1, toner containers 28 (shown in FIG. 2) respectively containing yellow, cyan, magenta, and black toners supplied to the development devices 13 are provided above the process cartridges 10.

Figure 2:
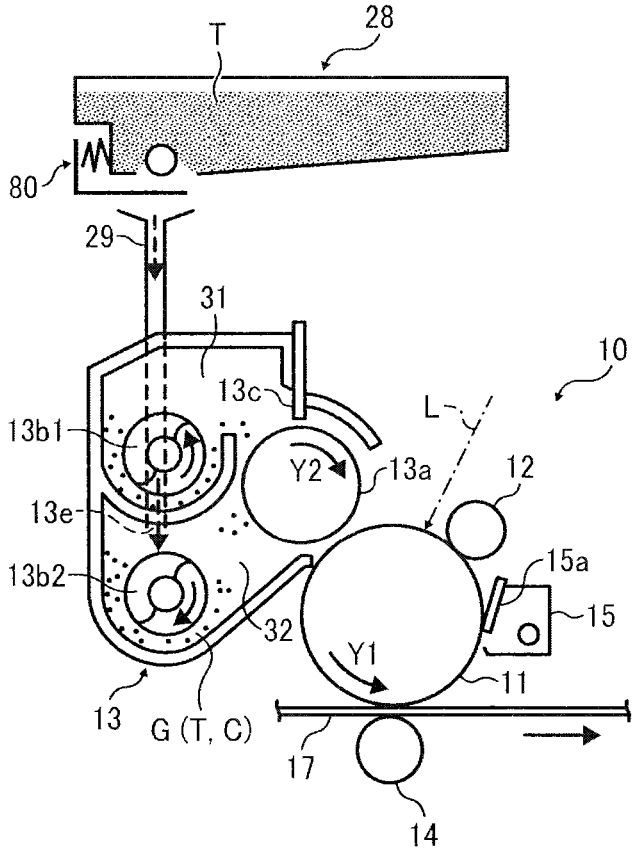
FIG. 2 illustrates an image forming unit including a process cartridge.

Operations of the image forming apparatus 100 shown in FIG. 1 to form multicolor images are described below. FIG. 2 is also referred to when image forming process performed on the respective photoreceptor drums 11 are described.

It is to be noted that the suffixes Y, M, C, and K attached to each reference numeral indicate only that components indicated thereby are used for forming yellow, magenta, cyan, and black images, respectively, and hereinafter may be omitted because the process cartridges 10Y, 10M, 10C, and 10BK have a similar configuration except the color of toner used in image formation.

In the document feeder 3, transport rollers transport original documents D set on a document table in a direction indicated by an arrow onto an exposure glass 5 of the document reading unit 4. Then, the document reading unit 4 reads image data of the original document D set on the exposure glass 5 optically.

More specifically, the document reading unit 4 scans the image on the original document D with light emitted from an illumination lamp. The light reflected by a surface of the original document is imaged on a color sensor via mirrors and lenses. The color sensor reads the multicolor image data of the original document D for each of decomposed colors of red, green, and blue (RGB) and convert the image data into electrical image signals. Further, the image signals are transmitted to an image processor that performs image processing (e.g., color conversion, color calibration, and spatial frequency adjustment) according to the image signals, and thus image data of yellow, magenta, cyan, and black are obtained.

The yellow, magenta, cyan, and black single-color image data is then transmitted to the writing unit 2, and the writing unit 2 directs laser beams L (shown in FIG. 2) corresponding to the single-color image data to the respective photoreceptor drums 11.

Meanwhile, the photoreceptor drums 11 in the four process cartridges 10 rotate clockwise in FIG. 1. As shown in FIG. 2, the surface of the photoreceptor drum 11 is charged by the charging member 12 (e.g., a charging roller) uniformly at a position facing the charging member 12 (charging process). Thus, the surface of the photoreceptor drum 11 is charged to a predetermined electrical potential.

When the surfaces of the photoreceptor drums 11 reach positions to receive the laser beams L, respectively, the writing unit 2 directs the laser beams L according to the respective color image data, emitted from four light sources, to the respective photoreceptor drums 11, which is referred to as an exposure process. The four laser beams L pass through different optical paths for yellow, magenta, cyan, and black.

The laser beam L corresponding to the yellow component is directed to the photoreceptor drum 11 in the process cartridge 10Y that is the first from the left in FIG. 1 among the four process cartridges 10. A polygon mirror that rotates at high velocity deflects the laser beam L for yellow in a direction of a rotation axis of the photoreceptor drum 11 (main scanning direction) so that the laser beam L scans the surface of the photoreceptor drum 11. Thus, an electrostatic latent image for yellow is formed on the photoreceptor drum 11 charged by the charging member 12.

Similarly, the laser beam L corresponding to the magenta component is directed to the photoreceptor drum 11 in the process cartridge 10M that is the second from the left in FIG. 1, thus forming an electrostatic latent image for magenta thereon. The laser beam L corresponding to the cyan component is directed to the third photoreceptor drum 11 from the left in FIG. 1, thus forming an electrostatic latent image for cyan thereon. The laser beam L corresponding to the black component is directed to the fourth photoreceptor drum 11 from the left in FIG. 1, thus forming an electrostatic latent image for black thereon.

Then, each photoreceptor drum 11 reaches a position facing the development device 13, and the development device 13 supplies toner of the corresponding color to the photoreceptor drum 11. Thus, the latent images on the respective photoreceptor drums 11 are developed into different single-color toner images in a development process.

Then, each photoreceptor drum 11 reaches a position facing the intermediate transfer belt 17 where the primary-transfer roller 14 is disposed in contact with an inner circumferential surface of the intermediate transfer belt 17. At these positions, the toner images formed on the photoreceptor drums 11 in the respective process cartridges 10 are sequentially transferred and superimposed one on another on the intermediate transfer belt 17 in a primary-transfer process, forming a multicolor toner image thereon.

After the primary-transfer process, the surface of each photoreceptor drum 11 reaches a position facing the cleaning unit 15, where the cleaning unit 15 collects any toner remaining on the photoreceptor drum 11 in a cleaning process.

Additionally, the surface of each photoreceptor drum 11 passes through a discharge device, and thus a sequence of image forming processes performed on each photoreceptor drum 11 is completed.

Meanwhile, the surface of the intermediate transfer belt 17 carrying the superimposed toner image moves counterclockwise and reaches the position facing the secondary-transfer roller 18. The secondary-transfer roller 18 transfers the multicolor toner image from the intermediate transfer belt 17 onto the sheet P (secondary-transfer process).

Further, the surface of the intermediate transfer belt 17 reaches a position facing the belt cleaning unit 16. The belt cleaning unit 16 collects any untransferred toner remaining on the intermediate transfer belt 17, and thus a sequence of transfer processes performed on the intermediate transfer belt 17 is completed.

The sheet P is transported from one of the sheet cassettes 7 via the registration rollers 9, and the like, to the secondary-transfer nip formed between the intermediate transfer belt 17 and the secondary-transfer bias roller 18.

More specifically, the feed roller 8 sends out the sheet P from the sheet cassette 7, and the sheet P is then guided by a sheet guide to the registration rollers 9. The registration rollers 9 forward the sheet P to the secondary-transfer nip, timed to coincide with the arrival of the multicolor toner image formed on the intermediate transfer belt 17.

Then, a transport belt transports the sheet P to the fixing device 20, and the toner image is fixed on the sheet P in a nip where a fixing belt and a pressure roller of the fixing device 20 press against each other.

After the fixing process, discharge rollers discharge the sheet P as an output image outside the image forming apparatus 100. Thus, a sequence of image forming processes is completed.

Next, image forming units are described in further detail below.

Figure 3:
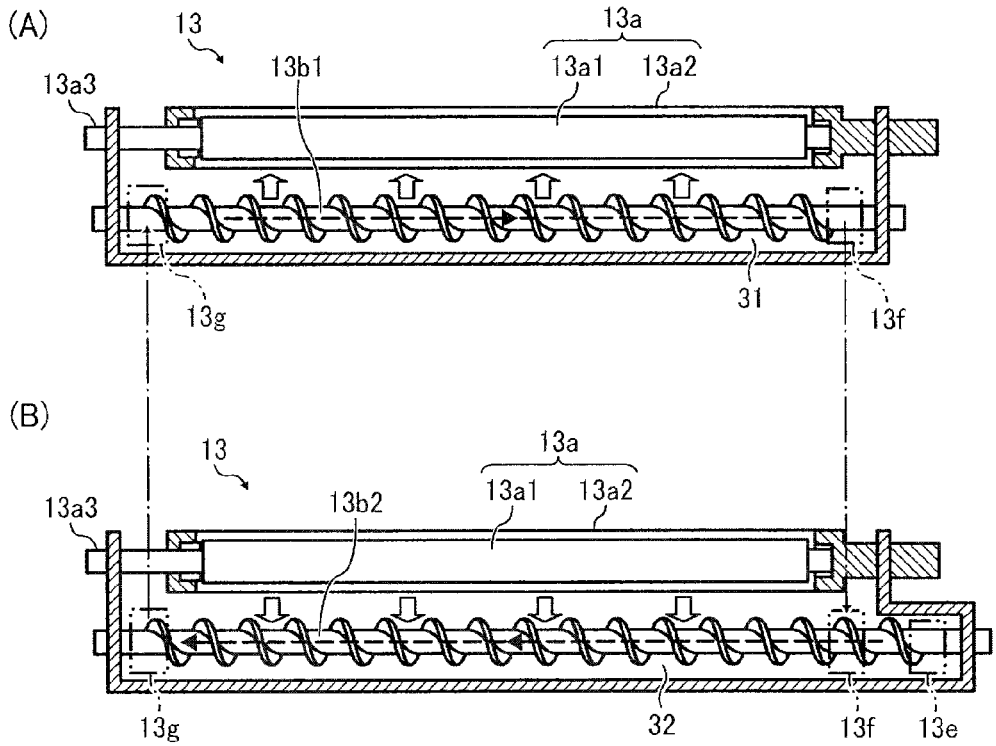
FIG. 3 schematically illustrates horizontal cross sections of the development device shown in FIG. 2, viewed in the longitudinal direction, and (A) and (B) respectively illustrate an upper portion and a lower portion of the development device.
Figure 4:
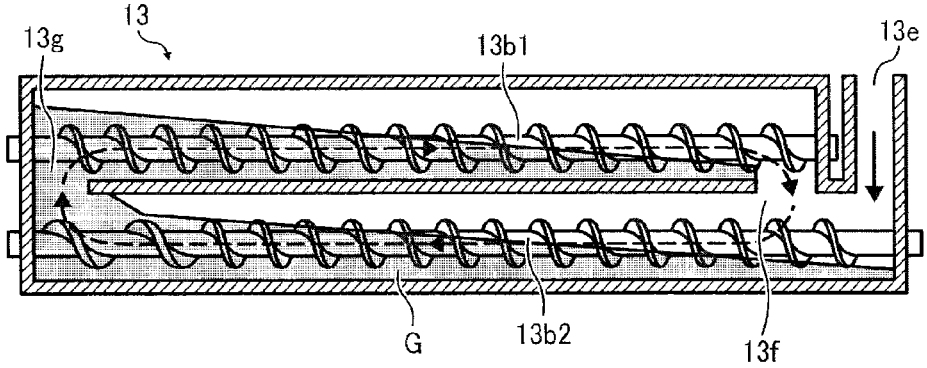
FIG. 4 illustrates a vertical cross section of the development device shown in FIG. 3, viewed in the longitudinal direction.

FIG. 2 illustrates the image forming unit including the process cartridge 10. FIG. 3 schematically illustrates horizontal cross sections of the development device 13, and (A) and (B) respectively illustrate an upper portion (first conveyance channel 31) and a lower portion (second conveyance channel 32) of the development device 13 in a longitudinal direction of the development device 13. FIG. 4 illustrates a vertical cross section of the development device 13 in the longitudinal direction.

As shown in FIG. 2, each process cartridge 10 includes the photoreceptor drum 11, the charging member 12, the development device 13, the cleaning unit 15, and the like.

The photoreceptor drum 11 in the present embodiment is a negatively-charged organic photoreceptor and is rotated counterclockwise in FIG. 2 by a driving unit.

The charging member 12 is an elastic charging roller and can be formed by covering a metal core with an elastic layer of moderate resistivity, such as foamed urethane layer, that includes carbon black as electroconductive particles, sulfuration agent, foaming agent, and the like. The material of the elastic layer of moderate resistivity include, but not limited to, rubber such as urethane, ethylene-propylene-diene (EPDM), acrylonitrile butadiene rubber (NBR), silicone rubber, and isoprene rubber to which electroconductive material such as carbon black or metal oxide is added to adjust the resistivity. Alternatively, foamed rubber including these materials may be used.

The cleaning unit 15 includes a cleaning blade 15*a* that contacts the surface of the photoreceptor drum 11 at a predetermined angle and a predetermined pressure to remove any toner adhering to the photoreceptor drum 11 mechanically. For example, the cleaning blade 15*a* can be a substantially planar member constructed of an elastic material such as urethane rubber.

The development device 13 includes a development roller 13*a*, serving as a developer bearer, disposed across a gap of predetermined size from the photoreceptor drum 11. In the portion where the development roller 13*a* faces the photoreceptor drum 11, a magnetic brush formed on the development roller 13*a* contacts the surface of the photoreceptor drum 11, thus forming a development range or development nip. The development device 13 contains two-component developer G including toner particles T (also "toner T") and carrier particles C (also "carrier C"). The development device 13 develops the latent image formed on the photoreceptor drum 11 with the developer G into a toner image. The configuration and operation of the development device 13 are described in further detail later.

Referring to FIG. 2, the toner container 28 contains toner T to be supplied to the development device 13. For example, the toner container 28 includes a shutter 80, and a controller of the image forming apparatus 100 shown in FIG. 1 causes a shutter driving unit to open and close the shutter 80 according to toner concentration, which is the ratio of toner T in the developer G, detected by a magnetic sensor provided to the development device 13, thus supplying toner T from the toner container 28 to the development device 13 as required.

It is to be noted that the data according to which toner T is supplied is not limited to toner concentration, and alternatively, toner T may be supplied according to toner consumption. For example, toner consumption may be determined based on the image density calculated from the reflectance of the toner image formed on the photoreceptor drum 11 or the intermediate transfer belt 17. Yet alternatively, toner T may be supplied according to a combination of such data.

A supply tube 29 connecting the toner container 28 to the development device 13 guides toner T from the toner container 28 to the development device 13. Thus, toner T discharged from the toner container 28 guided by the supply tube 29 can be reliably supplied to the development device 13 through a supply port 13*e* formed in the development device 13.

The development device 13 is described in further detail below.

Referring to FIGS. 2 to 4, the development device 13 includes the development roller 13*a* serving as a developer bearer, first and second conveyance screws (screw augers) 13*b*1 and 13*b*2 serving as developer conveyance members, and a doctor blade 13*c* serving as a developer regulator.

Reference character 13*a*3 shown in FIG. 3 represents a rotary shaft of the development roller 13*a*.

The development roller 13*a* includes a cylindrical sleeve 13*a*2 formed of a nonmagnetic material such as aluminum, brass, stainless steel, or conductive resin and is rotated clockwise in FIG. 2 by a driving unit. Referring to FIG. 3, a magnet 13*a*1 is provided inside the sleeve 13*a*2 and its position is fixed relative to the sleeve 13*a*2. The magnet 13*a*1 generates multiple magnetic poles around a circumferential surface of the sleeve 13*a*2. The developer G carried on the development roller 13*a* is transported in the direction indicated by arrow Y2 in FIG. 2 to the doctor blade 13*c*. The amount of the developer G on the development roller 13*a* is adjusted to a suitable amount by the doctor blade 13*c*, after which the developer G is carried to the development range facing the photoreceptor drum 11. Then, toner in the developer G adheres to the latent image formed on the photoreceptor drum 11 due to the effect of the magnetic field generated in the development range.

Being driven by a driving mechanism, the first and second conveyance screws 13*b*1 and 13*b*2 agitate and mix the developer G contained in the development device 13 while transporting the developer G horizontally in the longitudinal direction or the axial direction, perpendicular to the surface of the paper on which FIG. 2 is drawn.

The first conveyance screw 13*b*1 is disposed facing the development roller 13*a* and supplies the developer G to the development roller 13*a* as indicated by hollow arrows shown in FIG. 3 while transporting the developer G to the right in (A) of FIG. 3 as indicated by a broken arrow shown therein. It is to be noted that, in the present embodiment, the first conveyance screw 13*b*1 is configured to rotate counterclockwise in FIG. 2, which is the opposite the direction (indicated by arrow Y2) of rotation of the development roller 13*a*.

The second conveyance screw 13*b*2 is disposed beneath the first conveyance screw 13*b*1 and faces the development roller 13*a*. After image development, the developer G is forced by a developer release pole to leave the development roller 13*a* in the direction indicated by hollow arrow, and the second conveyance screw 13*b*2 transports the developer G that has left the development roller 13*a* to the left in the second conveyance channel 32 as indicated by a broken arrow shown in (B) of FIG. 3. It is to be noted that, in the present embodiment the second conveyance screw 13*b*2 is configured to rotate in the direction of rotation of the direction of the development roller 13*a*, that is, clockwise in FIG. 2.

Further, developer G is transported from the downstream portion of the first conveyance channel 31 to the upstream portion of the second conveyance channel 32 through a first communication port 13*f* as indicated by a downward broken arrow shown in FIG. 3 and is transported from the downstream portion of the second conveyance channel 32 to the upstream portion of the first conveyance channel 31 through a second communication port 13*g* as indicated by an upward broken arrow shown in FIG. 3 in the developer circulation direction.

The first and second conveyance screws 13*b*1 and 13*b*2 are disposed so that their axes of rotation are substantially horizontal similarly to the development roller 13*a* and the photoreceptor drum 11. Each of the first and second conveyance screws 13*b*1 and 13*b*2 are formed with a screw shaft and a bladed screw spiral winding around the screw shaft.

An inner wall of the development device 13 separates the first conveyance channel or supply channel 31 in which the first conveyance screw 13*b*1 is disposed from the second conveyance channel or collecting channel 32 in which the second conveyance screw 13*b*2 is disposed.

Referring to FIGS. 3 and 4, the downstream end portion of the second conveyance channel 32 in which the second conveyance screw 13*b*2 transports developer communicates with the upstream end portion of the first conveyance channel 31 through the second communication port 13*g*. In the second conveyance channel 32, the developer G that is not supplied to the development roller 13*a* accumulates adjacent to the first communication port 13*f* and then transported through the first communication port 13*f* to the upstream end portion of the second conveyance channel 32.

The downstream end portion of the first conveyance channel 31 in which the first conveyance screw 13*b*1 transports developer communicates with the upstream end portion of the second conveyance channel 32 through the first communication port 13*f*. In the downstream end portion of the second conveyance channel 32, the developer G falls under its own weight through the second communication opening 13*g* to the upstream end portion of the first conveyance channel 31.

With this configuration, a circulation channel through which the developer G is circulated in the longitudinal direction by the first and second conveyance screws 13*b*1 and 13*b*2 in the development device 13 is formed. That is, when the development device 13 is activated, the developer G contained therein flows in the developer circulation direction indicated by the broken arrows shown in FIGS. 3 and 4. Separating the first conveyance channel (supply channel) 31, in which the first conveyance screw 13*b*1 transports the developer G, from the second conveyance channel (collecting channel) 32, in which the developer G that has left the development roller 13*a* is collected, can reduce unevenness in the density of toner image on the photoreceptor drum 11.

It is to be noted that the magnetic sensor to detect the toner concentration in the developer circulated in the development device 13 is disposed in the collecting channel (second conveyance channel) 32. Based on the toner concentration detected by the magnetic sensor, the fresh toner T is supplied from the toner container 28 to the development device 13 through a supply inlet 13*e* disposed adjacent to the first communication opening 13*f* in the collecting channel 32.

Additionally, referring to FIGS. 3 and 4, the supply inlet 13*e* is formed in an upper portion on the upstream side of the collecting channel 32, in which the second conveyance screw 13*b*2 is disposed, away from the development range, that is, disposed outside the area occupied by the development roller 13*a* in the longitudinal direction. Disposing the supply inlet 13*e* close to the first communication opening 13*f* is advantageous in that the used developer that has left the development roller 13*a* can fall on the supplied toner whose specific gravity is smaller, and that the mixture is transported in the collecting channel 32 for a relatively long time. Accordingly, the supplied toner can be dispersed better in the developer.

It is to be noted that the position of the supply inlet 13*e* is not necessarily inside the collecting channel 32 but can be in an upper portion in the upstream portion of the supply channel 31, for example.

Distinctive features of the process cartridge 10 according to the present embodiment are described below with reference to FIGS. 5 through 9.

Figure 5:
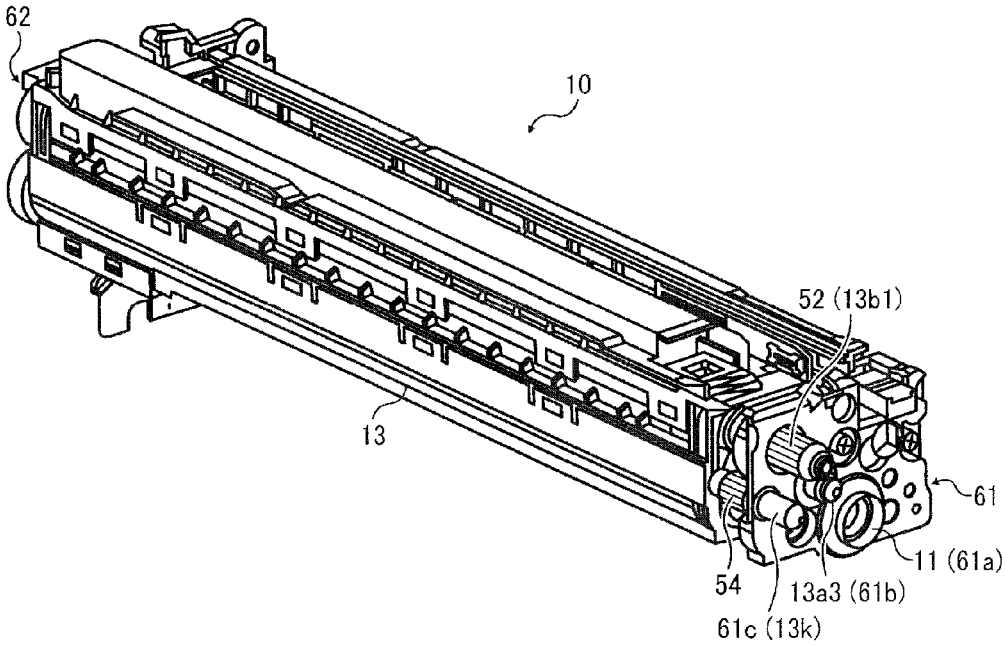
FIG. 5 is a perspective view of the process cartridge.
Figure 6:
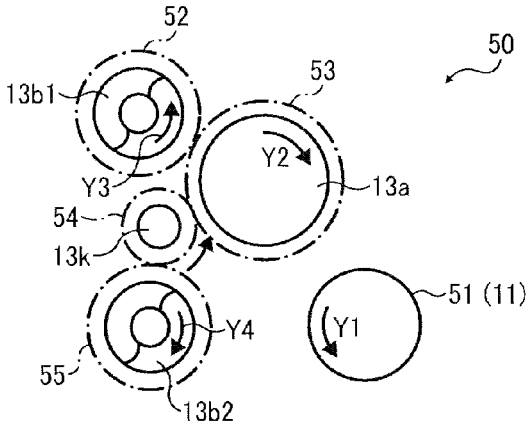
FIG. 6 is a schematic view of a gear train of the development device.
Figure 7:
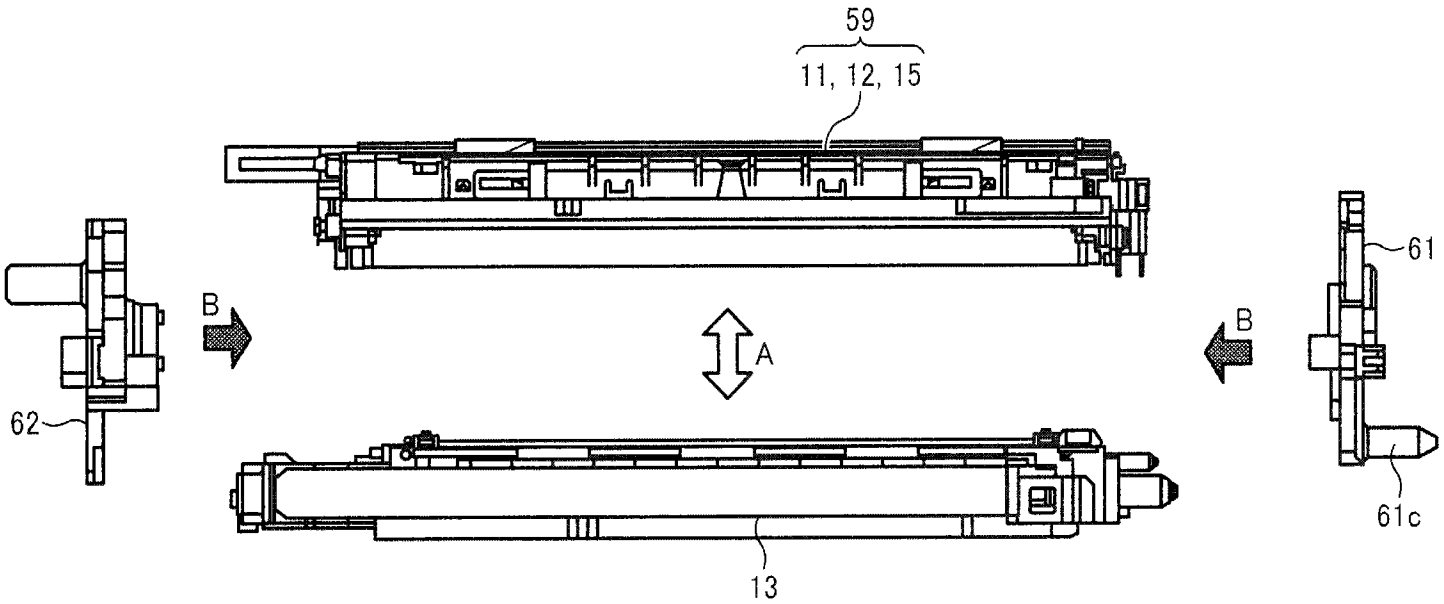
FIG. 7 is an exploded view of the process cartridge.

FIG. 5 is a perspective view of the process cartridge 10, and FIG. 6 is a schematic view of a gear train 50 of the development device 13 in the process cartridge 10. FIG. 7 is an exploded view of the process cartridge 10, and FIG. 8 is a perspective view that illustrates an interior of the development device 13 partly.

As described above with reference to FIG. 2, the process cartridge 10 is a modular unit including at least two of components such as the photoreceptor drum 11, the charging member 12, and the cleaning unit 15 and is removably installed in the apparatus body 1. Further, with reference to FIG. 7, the photoreceptor drum 11, the changing member 12, and the cleaning unit 15 are grouped into a photoreceptor unit 59 (shown in FIG. 7). That is, the process cartridge 10 includes two subunits, namely, the development device 13 (development unit) and the photoreceptor unit 59.

Additionally, referring to FIG. 6, the gear train 50 is provided to the development device 13 to transmit a driving force to the development roller 13*a* (developer bearer) and the first and second conveyance screws 13*b*1 and 13*b*2. When the process cartridge 10 is installed in the apparatus body 1, a first gear 52 of the gear train 50 engages a driving gear of the driving mechanism provided to the apparatus body 1.

Figure 8:
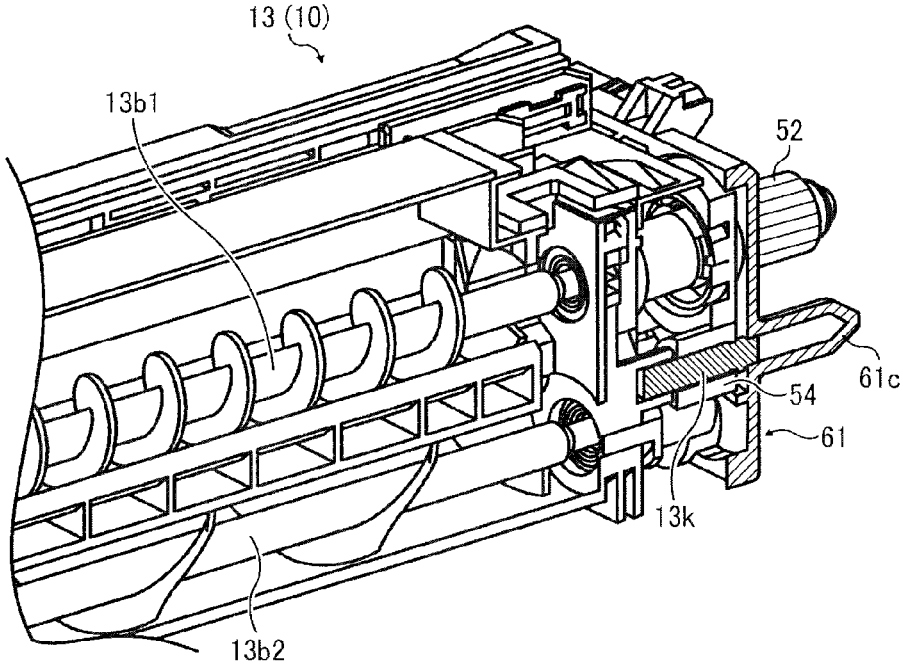
FIG. 8 is a perspective view that illustrates an interior of the development device.

Additionally, referring to FIGS. 6, 7, and 8, a hollow shaft 61*c* serving as a positioning pin is provided to the first side plate 61. An idler gear 54 is rotatably attached to a shaft 13*k* projecting in the axial direction from a development case 13*j*.

Figure 9:
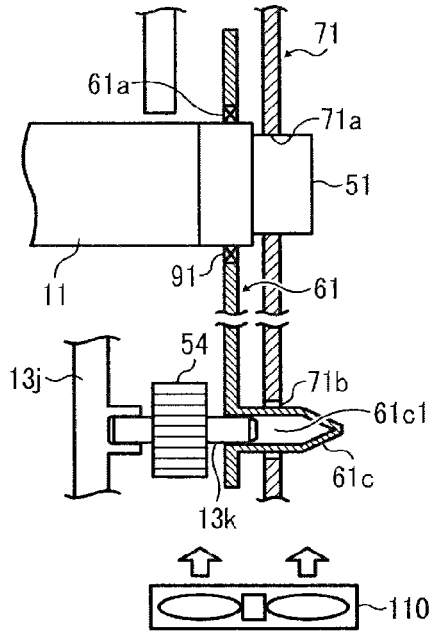
FIG. 9 is a schematic view of the process cartridge positioned relative to the body of the image forming apparatus.

FIG. 9 is a schematic view of the process cartridge 10 positioned relative to a side plate 71 of the apparatus body 1 of the image forming apparatus 1 where the driving mechanism is provided. It is to be noted that reference numeral 110 shown in FIG. 9 represents a cooling fan.

Referring to FIGS. 5, 6 and 9, the gear train 50 includes the first gear 52 provided to the rotary shaft of the first conveyance screw 13*b*1, a second gear 53 provided to the rotary shaft 13*a*3 of the development roller 13*a*, the idler gear 54 rotatably provided to the shaft 13*k* (shown in FIGS. 5 and 9) projecting in the axial direction (rotary shaft direction) from the development case 13*j* (shown in FIG. 9) of the development device 13, and a third gear 55 provided to the rotary shaft of the second conveyance screw 13*b*2. The second gear 53 engages the first gear 52 as well as the idler gear 54, and the idler gear 54 further engages the third gear 55.

With this configuration, when the first gear 52 receives a driving force transmitted from the apparatus body 1, the second gear 53, the idler gear 54, and the third gear 55 rotate in the directions indicated by arrows Y2, Y3, and Y4 shown in FIG. 6, respectively, thereby transmitting the driving force to the development roller 13*a* and the first and second conveyance screws 13*b*1 and 13*b*2.

Additionally, in the present embodiment, a flange 51 (shown in FIGS. 6 and 9) serving as a rotary shaft is provided to an axial end portion of the photoreceptor drum 11 in press fitting, and a driven coupling is formed on an inner diameter side of the flange 51. When the process cartridge 10 is installed in the apparatus body 1, the flange 51 is inserted in a hole 71*a* formed in a body plate 71 of the apparatus body 1. The hole 71*a* formed in the body plate 71 serves as an image bearer supporting hole.

Then, the driven coupling of the flange 51 engages a driving coupling of the driving mechanism provided to the apparatus body 1. Then, a driving force is transmitted from the apparatus body 1 to the driven coupling of the flange 51, and the driven coupling of the flange 51 rotates in the direction indicated by arrow Y1 shown in FIG. 6. Thus, the driving force is transmitted to the photoreceptor drum 11.

It is to be noted that, although the photoreceptor drum 11 and the development device 13 are driven by separated driving systems in the description above, alternatively, the photoreceptor drum 11 and the development device 13 may be driven by an identical driving system.

Further, although the coupling is used to drive the photoreceptor drum 11, gears may be used to drive the photoreceptor drum 11 instead.

Further, although the gears 52 through 55 of the gear train 50 are provided on the same side in the axial direction (perpendicular to the surface of the paper on which FIG. 2 or 6 is drawn and lateral direction in FIG. 9) in the configuration shown in FIGS. 5 and 6, the gears 52 through 55 may be separated into two groups provided on the opposite sides.

Referring to FIGS. 5 and 7 through 9, the process cartridge 10 includes a first side plate 61, serving as a positioning member, provided at an axial end of the process cartridge 10. Similarly, as shown in FIGS. 5 and 7, a second side plate 62 is provided at an axial end of the process cartridge 10 on the side opposite to the first side plate 61.

The first and second side plates 61 and 62 support the photoreceptor drum 11 and the development roller 13*a* rotatably at the axial end portions, respectively, thereby determining a distance M (shown in FIG. 10A) between the rotary shaft (i.e., a center of rotation) of the photoreceptor drum 11 and rotary shaft 13*a*3 of the development roller 13*a*.

More specifically, referring to FIGS. 5 and 9, first and second holes 61*a* and 61*b* are formed in the first side plate 61. The first and second holes 61*a* and 61*b* serve as an image bearer positioning portion and a developer bearer positioning portion of the first side plate 61. A part of the flange 51, more particularly, an outer circumferential portion of the flange 51, is inserted into the first hole 61*a* via a bearing 91. The rotary shaft 13*a*3 of the development roller 13*a* fits in the second hole 61*b* via a bearing. In the first side plate 61, a distance between centers of the first and second holes 61*a* and 61*b* are kept precisely. With this configuration, the distance M between the rotary shaft of the photoreceptor drum 11 and the rotary shaft 13*a*3 of the development roller 13*a* can be kept with a high degree of accuracy. Accordingly, the size of the development gap can be set as desired, attaining good performance in image development.

It is to be noted that, although not shown in FIG. 5, the first hole 61*a* in which the rotary shaft of the photoreceptor drum 11 fits via a bearing and the second hole 61*b* in which the rotary shaft 13*a*3 of the development roller 13*a* fits via a bearing are formed in the second side plate 62 similarly. With this configuration, the distance M between the rotary shaft of the photoreceptor drum 11 and that of the development roller 13*a* can be kept with a high degree of accuracy, and the desired size of the development gap can be kept over the entire axial length. Thus, good performance in image development can be secured.

It is to be noted that the material of the first and second side plates 61 and 62 can be metal, resin, or any material as long as it has a mechanical strength sufficient for securing the above-described configurations.

Assembling of the process cartridge 10 is described below.

Referring to FIG. 7, at factory, firstly the photoreceptor unit 59 including the photoreceptor drum 11, the changing member 12, and the cleaning unit 15; and the development device 13 (development unit) are moved to temporary positions in the directions indicated by arrow A shown in FIG. 7. Then, the first side plate 61 and the second side plate 62 are moved from both sides in the axial direction of the photoreceptor unit 59 and the development device 13 as indicated by arrows B shown in FIG. 7. Then, the axial end portions of the photoreceptor drum 11 and the development roller 13*a* are inserted into the first and second holes 61*a* and 61*b* formed in the first side plate 61. Similarly, the opposite end portions of the photoreceptor drum 11 and the development roller 13*a* are inserted into the first and second holes 61*a* and 61*b* formed in the second side plate 62. When the first and second side plates 61 and 62 are screwed to the photoreceptor unit 59 and the development device 13, assembling of the process cartridge 10 is completed.

Additionally, as shown in FIG. 9, the hollow shaft 61*c* projecting from the first side plate 61 in the axial direction is inserted in a positioning slot 71*b*, serving as a hollow shaft positioning hole, formed in the body plate 71 of the apparatus body 1. The shaft 13*k* to which the idler gear 54 is attached is fitted inside the hollow shaft 61*c*. That is, the shaft 13*k* fits in an inner diameter portion or a recess 61*c*1 (shown in FIG. 9) formed inside the hollow shaft 61*c* projecting from the first side plate 61.

More specifically, the hollow shaft 61*c* may be continuous with the first side plate 61 that can be formed of a resin material, together forming a single unit. For example, the hollow shaft 61*c* is a pin member having an outer diameter of about 6 mm and an inner diameter of about 3 mm. In assembling of the process cartridge 10 described with reference to FIG. 7, when the first side plate 61 is attached to the development device 13, the rotary shaft 13*a*3 of the development roller 13*a* is inserted into the second hole 61*b* (developer bearer positioning portion), and simultaneously the shaft 13*k* is inserted into the recess 61*c*1 (shown in FIG. 9) of the hollow shaft 61*c*. The recess 61*c*1 can be cylindrical. The outer diameter of a tip of the shaft 13*k* is designed such that the shaft 13*k* can fit in the hollow shaft 61*c* to fully contact the inner face of the hollow shaft 61*c*, and a force necessary for insertion and removal of the shaft 13*k* from the hollow shaft 61*c* can be relatively small. It is to be noted that a base portion of the shaft 13*k* is fixed to the development case 13*j*, more particularly, pressed in a recess (not a penetration hole) formed in the development case 13*j*. In the present embodiment, the shaft 13*k* is constructed of metal such as stainless steel.

In the configuration in which the shaft 13*k*, to which the idler gear 54 is rotatably attached, is thus supported by not only the development casing 13*j* but also the first side plate 61, damage to the shaft 13*k* can be prevented or reduced even if a relatively large load is applied to the development roller 13*a*, the first conveyance screw 13*b*1, or the second conveyance screw 13*b*2. Thus, the shaft 13*k* of the idler gear 54 can be prevented from falling dawn or broken. Accordingly, the development device 13 can be driven reliably.

Additionally, in the present embodiment, the tip portion of the shaft 13*k* is inserted into the recess 61*c*1 formed inside the hollow shaft 61*c*. With this configuration, it is not necessary to secure a space in the first side plate 61 for a hole in which the tip of the shaft 13*k* is inserted separately from the hollow shaft 61*c*. Therefore, increases in size of the first side plate 61, or limitations in layout of components of the development device 13, namely, the development roller 13*a*, the first and second conveyance screws 13*b*1 and 13*b*2, and the gear train 50, can be alleviated. Thus, the development device 13 and the process cartridge 10 can be kept relatively compact, and the configuration according to the present embodiment does not impose a significant limitation in designing the entire process cartridge 10.

It is to be noted that, referring to FIG. 9, the hollow shaft positioning hole (positioning slot 71*b*), into which the hollow shaft 61*c* of the first side plate 61 is inserted, formed in the apparatus body 1 (body plate 71) can be a slot serving as a sub-positioning reference in installation of the process cartridge 10 in the apparatus body 1.

The hole 71*a* (image bearer supporting hole) formed in the body plate 71 can serve as a main positioning reference in installation of the process cartridge 10. The first side plate 61 is configured so that the rotary shaft (flange 51) of the photoreceptor drum 11 fits in the hole 71*a* via a bearing. Additionally, the positioning slot 71*b* serving as the sub-positioning reference is positioned with its longitudinal direction oriented to the hole 71*a*. In other words, the positioning slot 71*b* is positioned such that a virtual segment in the longitudinal direction thereof passing through a center of the positioning slot 71*b* passes a center of the hole 71*a*.

With this configuration, the relative positions of the apparatus body 1 and the photoreceptor drum 11 can be determined with the hole 71*a* (main positioning reference), and the development gap or the distance M (shown in FIG. 10A) between the rotary shafts of the photoreceptor drum 11 and the development roller 13*a* can be determined with the first side plate 61. In other words, even if the distance M (shown in FIG. 10A) between the hole 71*a* (main positioning reference) and the positioning slot 71*b* (sub-positioning reference) in the body plate 71 is deviated from a target distance, the development gap or the distance between the rotary shafts of the photoreceptor drum 11 and the development roller 13*a* is not affected by it but can be kept accurately due to positional accuracy of the first and second holes 61*a* and 61*b* formed in the first side plate 61.

It is to be noted that, although the hollow shaft 61*c* engages the positioning slot 71*b* that is a long hole in the description above, alternatively, the positioning slot 71*b* may be oval in cross section. Also in this case, it is preferable that the oval hollow shaft positioning hole serving as the sub-positioning reference is positioned with its longitudinal direction oriented to the hole 71*a*.

It is to be noted that, when the shaft 13*k* is constructed of metal, heat generated by the idler gear 54 slidingly contacting the shaft 13*k* can easily diffuse from the sliding contact portion to other portions, thus facilitating heat radiation. Instead, when the hollow shaft 61*c* or the first side plate 61 is constructed of metal, heat generated by the idler gear 54 slidingly contacting the shaft 13*k* can be radiated outside similarly, thus alleviating temperature rise of the process cartridge 10 at a position adjacent to the idler gear 54. This configuration can reduce image failure such as absence of toner, creating white lines, caused by aggregation of toner inside the development device 13.

In particular, as shown in FIG. 9, when the cooling fan 110 is provided to cool the shaft 13*k* (or the hollow shaft 61*c*) and adjacent areas, airflow can be generated adjacent to the idler gear 54 by air from the cooling fan 110, and it can aggressively diffuse the heat generated by the idler gear 54 slidingly contacting the shaft 13*k*. Thus, temperature rise of the process cartridge 10 or adjacent to the idler gear 54 can be alleviated better.

Figure 10A:
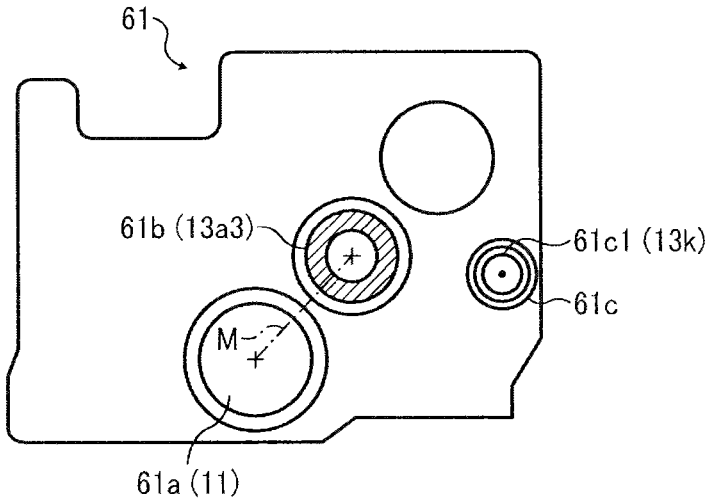
FIG. 10A is a front view of a first side plate as viewed from the side of the development device.
Figure 10B:
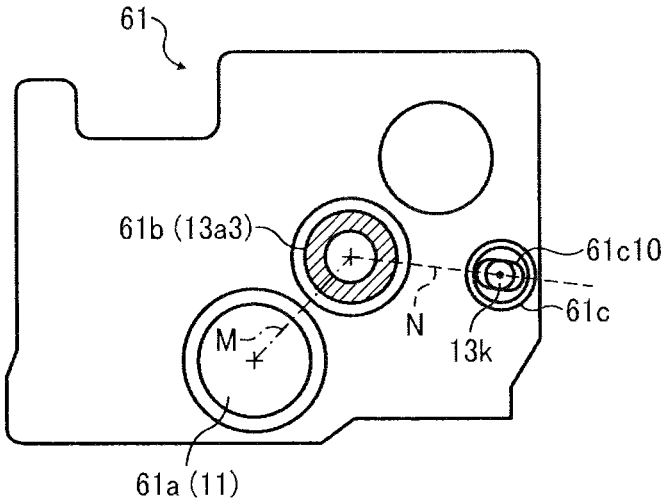
FIG. 10B is a front view of a first side plate according to a variation as viewed from the side of the development device.

FIG. 10A is a front view of the first side plate 61 according to the present embodiment as viewed from the development device 13 (or the photoreceptor drum 11), and FIG. 10B is a front view of the first side plate 61 according to a variation as viewed from the development device 13 (or the photoreceptor drum 11). It is to be noted that in FIGS. 10A and 10B, holes other than the first and second holes 61*a* and 61*b* and the hollow shaft 61*c* are omitted for simplicity.

As shown in FIG. 10A, in the present embodiment, the interior of the hollow shaft 61*c* provided to the first side plate 61 is a circular hole (i.e., inner diameter portion or recess 61*c*1), and the shaft 13*k* of the idler gear 54 is inserted into the circular recess 61*c*1.

By contrast, in the variation shown in FIG. 10B, inside the hollow shaft 61*c*, an inner diameter portion or recess 61*c*10 shaped like a long hole, a slot, or an oval is formed, and the shaft 13*k* of the idler gear 54 is inserted into the recess 61*c*10. In the variation shown in FIG. 10B, the rotary shaft 13*a*3 of the development roller 13*a* can serve as a main positioning reference, and the shaft 13*k* of the idler gear 54 can serve as a sub-positioning reference in positioning of the development device 13 relative to the first side plate 61. Accordingly, even if manufacturing accuracy of the distance M between the center of the second hole 61*b* and that of the hollow shaft 61*c* (recess 61*c*10) in the first side plate 61 is not very high, the position of the shaft 13*k* of the idler gear 54 can be determined within the recess 61*c*10, and changes in the size or position of the development gap caused by deformation of the first side plate 61 can be prevented. In other words, when the first side plate 61 is configured as shown in FIG. 10A, it is possible that the development gap changes unless manufacturing accuracy of the distance M between the center of the second hole 61*b* and that of the hollow shaft 61*c* (recess 61*c*1) in the first side plate 61 is relatively high.

It is to be noted that when the interior of the hollow shaft 61*c* is shaped into the slot or oval recess 61*c*10 as shown in FIG. 10B, it is preferable that the longitudinal direction of the recess 61*c*10 is oriented to the second hole 61*b* formed in the first side plate 61 and serving as a positioning reference for the rotary shaft 13*a*3 of the development roller 13*a*. In other words, the recess 61*c*10 having a cross section shaped like a long hole is disposed such that a virtual segment N in the longitudinal direction of the long hole-shaped cross section of the recess 61*c*10 passing through a center of the recess 61*c*10 passes a center of the second hole 61*b*. With this configuration, the shaft 13*k* (i.e., the recess 61*c*10) can serve as the sub-positioning reference reliably. Additionally, even if the shaft 13*k* is deviated from the center of the recess 61*c*10, adverse effects caused thereby on drive transmission between the second gear 53 and the idler gear 54 can be reduced.

As described above, in the embodiment described above, the hollow shaft 61*c* is provided to the first side plate 61 of the process cartridge 10. The hollow shaft 61*c* is inserted in the positioning slot 71*b* (hollow shaft positioning hole) formed in the apparatus body 1 (body plate 71), and the shaft 13*k* of the idler gear 54 fits in the recess 61*c*1 inside the hollow shaft 61*c*. This configuration can reduce damage to the shaft 13*k*, thus preventing breakage of the shaft 13*k*, without imposing a significant limitation in the size or layout of the first side plate 61 or process cartridge 10.

It is to be noted that, although the description above concerns a configuration in which the number of the developer conveyance members is two (i.e., the conveyance screws 13*b*1 and 13*b*2), the shape and number of the developer conveyance members are not limited thereto. For example, the above-described features of the present embodiment can adapt to configurations in which the number of developer conveyance members is three or greater, or a paddle is used as the developer conveyance member.

Additionally, although the description above concerns a configuration including a single development roller 13*a*, above-described features of the present embodiment can adapt to configurations including multiple development rollers 13*a* arranged vertically.

In such configurations, similar effects can be attained when the hollow shaft 61*c* similar to the description above is provided to the first plate 61 of the process cartridge.

Additionally, although image forming apparatus 100 is tandem type and employs an intermediate transfer method in the description above, the features of the above-described embodiment can adapt to image forming apparatuses of other types, such as direct transfer type image forming apparatuses or single-color image forming apparatuses.

Moreover, although the process cartridge 10 includes subunits: the photoreceptor unit 59 and the development device 13 in the description above, the configuration of the process cartridge 10 is not limited thereto. For example, the process cartridge 10 may includes, as subunits, the photoreceptor drum 11, the development device 13, the charging member 12, and the cleaning unit 15. Alternatively, only the photoreceptor drum 11 and the development device 13 can be housed in a common unit casing, forming the process cartridge 10.

Numerous additional modifications and variations are possible in light of the above teachings. It is therefore to be understood that, within the scope of the appended claims, the disclosure of this patent specification may be practiced otherwise than as specifically described herein.

What is claimed is:

1. A process cartridge removably installed in a body of an image forming apparatus, the process cartridge comprising:

an image bearer to rotate in a predetermined direction;

a development device to develop, with developer contained therein, a latent image formed on the image bearer, the development device including:

a developer bearer disposed rotatably and facing the image bearer, a developer conveyance member to rotate and transport developer inside the development device, and a shaft projecting from a development casing in an axial direction of the developer bearer;

a gear train to transmit a driving force to the developer bearer and the developer conveyance member, the gear train including an idler gear rotatably provided on the shaft projecting from the development casing;

a first side plate to determine a distance between a rotary shaft of the image bearer and a rotary shaft of the developer bearer, the first side plate including a first image bearer positioning portion to rotatably support a first axial end portion of the image bearer and a first developer bearer positioning portion to rotatably support a first axial end portion of the developer bearer; and a hollow shaft projecting in the axial direction through the first side plate and inserted into a hollow shaft positioning hole formed in the body of the image forming apparatus, the hollow shaft having a recess formed therein to receive the shaft projecting from the development casing.

2. The process cartridge according to claim 1, further comprising a second side plate disposed on a side opposite the first side plate, wherein the second side plate includes a second image bearer positioning portion to rotatably support a second axial end portion of the image bearer and a second developer bearer positioning portion to rotatably support a second axial end portion of the developer bearer to determine the distance between the rotary shaft of the image bearer and the rotary shaft of the developer bearer on the side opposite the first side plate.

3. The process cartridge according to claim 1, wherein at least one of the hollow shaft, the shaft projecting from the development casing, and the first side plate is constructed of a metal material.

4. The process cartridge according to claim 1, wherein an image bearer supporting hole into which the rotary shaft of the image bearer is inserted is formed in the body of the image forming apparatus as a main positioning reference for positioning the process cartridge relative to the body of the image forming apparatus, the hollow shaft positioning hole formed in the body of the image forming apparatus is shaped into a slot or an oval and serves as a sub-positioning reference, and a longitudinal direction of the hollow shaft positioning hole is oriented to the image bearer supporting hole.

5. The process cartridge according to claim 1, further comprising a cooling fan to cool the shaft projecting from the development casing.

6. The process cartridge according to claim 1, wherein the recess formed inside the hollow shaft projecting from the first side plate is circular in cross section.

7. The process cartridge according to claim 1, wherein the recess formed inside the hollow shaft projecting from the first side plate is shaped into a slot or an oval in cross section.

8. The process cartridge according to claim 7, wherein the recess formed inside the hollow shaft is positioned with a longitudinal direction thereof oriented to the first developer bearer positioning portion of the first side plate.

9. An image forming apparatus comprising:

a body; and a process cartridge removably installed in the body, the process cartridge including:

an image bearer to rotate in a predetermined direction;

a development device to develop, with developer contained therein, a latent image formed on the image bearer, the development device including:

a developer bearer disposed rotatably and facing the image bearer, a developer conveyance member to rotate and transport developer inside the development device, and a shaft projecting from a development casing in an axial direction of the developer bearer;

a gear train to transmit a driving force to the developer bearer and the developer conveyance member, the gear train including an idler gear rotatably provided on the shaft projecting from the development casing;

a first side plate to determine a distance between a rotary shaft of the image bearer and a rotary shaft of the developer bearer, the first side plate including a first image bearer positioning portion to rotatably support a first axial end portion of the image bearer and a first developer bearer positioning portion to rotatably support a first axial end portion of the developer bearer; and a hollow shaft projecting in the axial direction through the first side plate and inserted into a hollow shaft positioning hole formed in the body of the image forming apparatus, the hollow shaft having a recess formed therein to receive the shaft projecting from the development casing.

10. The process cartridge according to claim 1, wherein the shaft projecting from the development casing is disposed between the development casing and the first side plate.

11. The process cartridge according to claim 1, wherein the first side plate covers an axial end of the shaft projecting from the development casing, which axial end is distal from the development casing.

12. The process cartridge according to claim 1, wherein the hollow shaft and the first side plate are continuous with each other and formed into a single unit.

13. The process cartridge according to claim 12, wherein the hollow shaft and the first side plate are formed of a resin material.

14. The process cartridge according to claim 13, wherein the shaft projecting from the development casing is formed of metal.

15. The image forming apparatus according to claim 9, wherein the shaft projecting from the development casing is disposed between the development casing and the first side plate.

16. The image forming apparatus according to claim 9, wherein the first side plate covers an axial end of the shaft projecting from the development casing, which axial end is distal from the development casing.

17. The process cartridge according to claim 9, wherein the hollow shaft and the first side plate are continuous with each other and formed into a single unit.

18. The process cartridge according to claim 17, wherein the hollow shaft and the first side plate are formed of a resin material.

19. The process cartridge according to claim 18, wherein the shaft projecting from the development casing is formed of metal.

* * * * *